United States Patent [19]

Nagel

[11] Patent Number: 4,785,511

[45] Date of Patent: Nov. 22, 1988

[54] METHOD FOR MANUFACTURING PRE-ASSEMBLED, TWO-PART MERCHANDISE DISPLAY HOOKS AND THE LIKE

[75] Inventor: Thomas O. Nagel, Blairstown, N.J.

[73] Assignee: Trion Industries Inc., Wilkes-Barre, Pa.

[21] Appl. No.: 41,854

[22] Filed: Apr. 22, 1987

[51] Int. Cl.[4] ..... B21K 1/44

[52] U.S. Cl. ..... 79/7; 29/417; 29/450; 29/525; 29/810

[58] Field of Search ..... 29/7, 417, 450, 525, 29/809, 810; 248/220.2

[56] References Cited

U.S. PATENT DOCUMENTS 3,815,198 6/1974 Thalenfeld ..... 29/417 X

*Primary Examiner*—Timothy V. Eley

*Attorney, Agent, or Firm*—Schweitzer & Cornman

[57] ABSTRACT

An improved method of forming and assembling two-part merchandise display hooks, including new design features of the hook itself, enable two-part hooks to be manufactured and assembled at extremely low cost. Wire from a continuous length is gripped and bent to form the outer portion of the hook. The wire is then severed and bent in a single operation to form a hook-mounting portion. While the severed wire remains gripped by its shaped outer end, a preoriented and guided base member is applied over the just-formed mounting portion of the wire. A retractable bend-forming member is withdrawn when the base member is applied to the wire, to enable the bent portion to be fully received within the plastic base. Major manufacturing economies are realized.

8 Claims, 3 Drawing Sheets

METHOD FOR MANUFACTURING PRE-ASSEMBLED, TWO-PART MERCHANDISE DISPLAY HOOKS AND THE LIKE

BACKGROUND AND SUMMARY OF THE INVENTION

In the display and marketing of a wide variety of merchandise, it is common practice to utilize apertured panel board, to which are attached a plurality of merchandise display hooks. In the beginning, such merchandise display hooks typically were formed of all-metal construction, sometimes being formed entirely of metal wire and sometimes having a wire hook portion secured to a metal plate for mounting on a panel board. Conventional merchandise display hooks include an outwardly extending merchandise support arm, typically with an upturned outer end and frequently provided with a ball-like enlargement at the outer extremity for safety purposes. At the inner end, the hook is provided with a pair of spaced, upturned L-shaped lugs, which are received in an adjacent pair of openings in an apertured panel board for mounting of the hook on the panel.

In recent periods, there has been a developing interest in reducing the manufacturing cost of merchandise display hooks through the use of molded plastic base members, which can be assembled with a pre-formed wire hook section. The molded plastic base is formed with an upwardly opening socket, to receive a downward extension of the wire member, and integral plastic lugs extend rearward from the base member for reception in the panel apertures. Representative of such previous proposals, but by no means representing an exhaustive list, are the Lucietto, et al. U.S. Pat. No. 3,452,954, the Silver U.S. Pat. No. 3,897,926, the Gibbons U.S. Pat. No. 4,405,110, the Thalenfeld U.S. Pat. No. 4,474,351 and the Thalenfeld U.S. Pat. No. 4,512,481. The latter two examples are owned by Trion Industries Inc., Wilkes-Barre, Pa.

Assembly of the wire display elements to the plastic base portions historically has required a rather laborious manual assembly operation. Accordingly, in order to minimize the cost of the product from the manufacturer, it has been the custom of the trade to furnish the two-part, plastic base hooks to the customer in unassembled form. In other words, the customer receives a specified number of hook components, consisting of the desired number of wire hook elements and an equal number of plastic bases. Typically, the customer's personnel assemble the hooks and bases individually as they are installed on the display panel. Quite obviously, it requires a more or less equivalent number of man hours to assemble the two-part hook devices, whether the assembly is done by the original manufacturer or by the customer during installation. Nevertheless, the customer has historically been more willing to accept the labor cost during the setup and installation of a merchandise display than to accept the additional cost from the manufacturer.

The present invention represents a significant breakthrough in the art of manufacture and marketing of two-part plastic base merchandise display hooks in that it becomes possible, using the invention, for the manufacturer to preassemble and ship to the customer already assembled hooks at a cost which is actually less than the cost of shipping to that same customer the individual unassembled components. It thus becomes possible to provide to the customer a much superior product, in the form of a preassembled two-part hook, at a cost that is highly attractive to the customer in relation to previous practice.

The invention is directed in part to the provision of new methods for the formation of wire hook elements and the assembly thereof together with previously molded plastic members. The invention is also directed in part to design features of the hook itself, which accommodate and enable the hook to be manufactured and automatically preassembled on a high production, lost cost basis.

In the mass production manufacture of merchandise display hooks, it is quite customary to mass produce the hook elements from a continuous coil of wire, using multiple action wire forming machines. On such machines, wire sections of predetermined length are advanced in a step-by-step basis and the individual wire sections are cut and shaped to the desired hook-like form. The output of the machine is ejected into an appropriate container for counting, weighing, etc. To a package of a given number of pre-formed hook elements, an equivalent number of plastic bases is later added, and the package is then ready to be shipped to the customer.

In accordance with the practice of the present invention, the wire sections, are processed in a unique and advantageous manner in the wire forming machine, and the individual hook sections are retained in a precisely gripped and aligned relationship after formation of the hook to the desired configuration. Individual plastic base members, properly oriented and positioned, are fed one at a time into an assembly position, precisely aligned with respect to the hook-mounting portion of the shaped wire section. As soon as the wire section has been formed, a base member is pressed together with the hook-mounting portion of the wire to provide a finished, preassembled two-part hook, which is then ejected from the machine into the appropriate container for counting, weighing or the like.

The accomplishment of the seemingly simple objective as described in the preceding paragraph, involves a special configuration of the forming dies and of the plastic base itself, to assure proper alignment of the various elements and to accommodate the necessary assembly operations. Such reconfiguration and redesign forms a significant aspect of the present invention.

Pursuant to the invention, the wire-forming machine is provided with a special set of forming dies which are arranged, upon the infeeding of a predetermined length of wire, to grip and shape the outer end portion of the hook. The dies utilized for this purpose remain tightly closed, and serve to firmly grip and position the wire for the remainder of the operations. Immediately following gripping of the wire and shaping of its outer end, a movable cutting die is actuated to sever the wire to its desired length. The cutting die is especially shaped and configured to engage the trailing end of the wire after cutting and, in a continuous motion, to guide and bend the end of the wire to form the hook-mounting portion thereof. To this end, the movable cutting die is grooved along one face so that, during its continued motion for bending of the wire, it closely confines and guides the wire and assures a high degree of positional accuracy in the finished wire form.

In accordance with another aspect of the invention, the wire-forming machine is provided with a special, retractable bend-forming element, which is projectable into a position in contact or near contact with the wire, on the opposite side thereof from the movable cutting die. As the movable cutting die completes the severing of the wire and commences the bending thereof, the retractable bend-forming member serves as a fulcrum about which wire is bent. Immediately thereafter, the retractable bend-forming member is withdrawn, as is the movable cutting die, to enable a plastic base member to be assembled with the just-formed hook-mounting section.

In accordance with another significant aspect of the invention, the plastic base member itself is redesigned to accommodate automatic feeding and handling, so that it may be precisely aligned with and assembled to the formed wire section. To this end, the plastic base member is molded in a single piece and is shaped and configured to provide, in effect, a flat, panel-like portion of generally rectangular configuration. A body portion projects forwardly from the panel-like portion and is provided with an open socket for the snug reception of the hook-mounting portion of the wire. A pair of spaced, L-shaped mounting lugs project rearwardly from the back face of the panel-like portion. Importantly, both the body portion, projecting from the front face of the panel portion, and the L-shaped lugs, projecting from the rear face, are confined within the center area of the panel portion, to provide for a marginal flange around the entire periphery of the base portion. This marginal flange enables automated orientation of the base members and thus their automatic feeding into a predetermined assembly position. In the assembly position, the base members are guided and confined by the marginal edge flanges, so that precise alignment of the base members is assured during the assembly operations.

The various features of the invention enable a high speed formation and assembly of the wire hook members in a wire-forming machine, to provide for high speed, automated production of preassembled hooks at an extremely low cost. The speed and reliability with which the production and assembly operations can be carried out exceeds the rate at which, heretofore, it has been possible to simply package the plastic bases together with an equivalent number of wire hooks, such that the manufacturing cost of the preassembled device is actually less than the manufacturing cost of the unassembled device according to conventional practices.

For a more complete understanding of the above and other features and advantages of the invention, reference should be made to the following detailed description of a preferred embodiment of the invention and to the accompanying drawings.

DESCRIPTION OF A PREFERRED EMBODIMENT OF THE INVENTION

Figure 1:
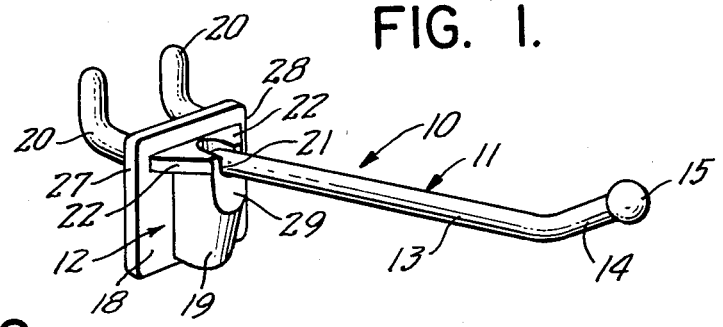
FIG. 1 is a perspective illustration of an assembled merchandise display hook constructed in accordance with the principles of the invention, including a formed wire hook member and a molded plastic base member.
Figure 2:
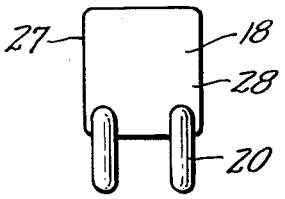
FIG. 2 is an inverted back elevation of the hook assembly of FIG. 1.
Figure 3:
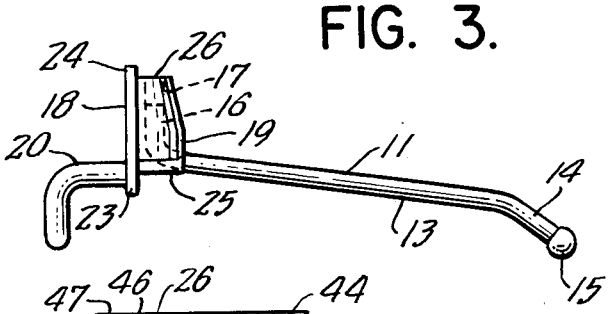
FIG. 3 is an inverted side elevation of the assembled hook of FIG. 1.

Referring now the drawing, and initially to FIGS. 1–3 thereof, a merchandise hook according to the invention is represented generally by the reference numeral 10. The hook consists of two principal parts, a wire hook portion 11 and a molded plastic base portion 12. The wire portion 11 is generally conventional in its configuration, comprising a generally straight, slightly upwardly tilted support arm 13 for suspending carded merchandise, an upwardly tilted outer end portion 14 and, typically, a balled end 15. At its inner extremity, the wire is formed with a downwardly bent mounting portion 16 (see FIG. 3), which is snugly received in a socket 17 formed in the plastic base member 12.

The plastic base member 12, of the display hook shown in FIGS. 1–3, is especially designed, in accordance with the invention, to accommodate high speed, automatic assembly of the wire and base portions 11, 12. Conventionally, the base member 12 includes a panel-like backing plate 18, a forwardly projecting body portion 19 provided with the socket 17 for reception of the merchandise support wire, and a pair of generally L-shaped mounting lugs 20 projecting rearwardly from the backing plate 18. In accordance with known constructions, the wire-receiving socket 17 extends vertically from top to bottom of the plastic base member and is also provided with a forwardly facing open portion 21. When the wire element 11 is fully seated in its socket 17, the downwardly bent mounting portion 16 is received in the vertical socket portion, and the inner extremity of the outwardly projecting portion 13 is seated in the forwardly facing opening 21 to restrain the wire from side to side movement. Typically, integral gusset elements 22 are molded into the base member 12 to strengthen the base member against side to side forces applied to the assembled wire 11.

In accordance with one aspect of the invention, the base member 12 is so designed and constructed that the backing plate 18, in the form of a flat, panel-like element, is of generally rectangular configuration and, significantly, is provided with free marginal flange portions about its entire periphery. Thus, as shown in FIG. 3, upper and lower marginal flanges 23, 24 project above and below the top and bottom surfaces 25, 26 respectively of the base member body portion 19. Likewise, the upper flange 23 projects above the uppermost surfaces of the L-shaped lugs 20, where they join with the backing plate 18. As shown in FIG. 2, opposite side flange portions 27, 28 of the backing plate 18 project laterally beyond the opposite outer sides of the L-shaped lugs 20. Similarly, as shown in FIG. 1, these side flanges 27, 28 project slightly beyond the opposite edge extremities of the reinforcing gussets 22. The arrangement is such, in accordance with the invention, that the outer flange margins 23, 24 and 27, 28 of the base member may be gripped and/or guided during various phases of the assembly procedure, in order to enable integration of the device into a high speed, production assembly operation. By way of example, in a typical practical commercial embodiment of the invention, a marginal flange of at least about 1/16th of an inch is provided about the periphery of the panel-like backing plate 18 for these purposes. Also, desirably, the upper and lower surfaces 25, 26 of the body portion 19 are flat and parallel, and the front extremity 29 of the body portion constitutes a flat surface which is parallel to the back surface of the backing plate 18. These features facilitate the guiding' and orientation of the base member during the assembly procedures.

In the practice of the invention, the molded base members 12 are discharged in a random manner into a supply hopper 30 which delivers them in a somewhat distributed manner from a discharge pan 31 into a rotating vibratory feeder device 32. The feeder device 32 is of a conventional, commercially available type and, per se, forms no part of the invention. Its function is to continuously move and reorient the random base members 12 until they are able to line up with guide means provided at the outlet of the feeder bowl. The properly oriented base members are advanced around a guide track 33 (FIG. 4) until they reach a conveyor section 34 comprising guide track means 35 to be described and a driven belt member 36 which serves to advance the oriented base members to an assembly position, indicated in FIG. 4 by the reference numberal 37. The conveyor section 35 includes a guide plate 38, mounting a plurality of belt sheaves 39 supporting the conveyor belt 36, which is driven by a motor 40.

Figure 5:
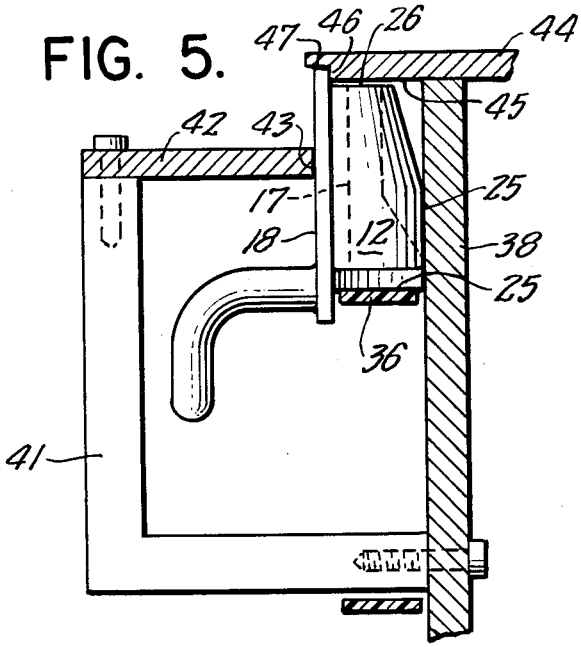

In the illustrated arrangement, shown in FIG. 5, the individual base members 12 are supported in an inverted position by means of the upper reach of the conveyor belt 36, which engages the flat "upper" surfaces 25 of the inverted base members. The flat "forward" surface 25 of the base member confronts and is guided by the surface of the main guide plate 38.

At spaced intervals along the main guide plate 38, there are mounted support brackets 41 mounting a continuous outer guide strip 42. An inwardly projecting front edge 43 of the guide strip is spaced from the face of the guide plate 38 and serves to guide and confine the base member 12 by sliding contact with the back surface of the backing plate 18.

The upwardly facing "bottom" of the inverted base member 12 is confined and guided by an upper guide plate 44, secured to the vertical guide plate 38 and extending horizontally therefrom. The bottom surface 45 of the guide plate confronts and confines the "bottom" surface 26 of the base member. In addition, a notch in the projecting portion of the upper guide plate 44 provides guide surfaces 46, 47 which confront and guide the front face and "bottom" edge respectively of the bottom flange margin 24 of the backing plate.

As will be evident in FIG. 5, the oriented base members 12 are fully confined by the guide plates 38, 44 and the guide strip 42, in conjunction with the driven belt 36. The belt 36 advances the base members toward the assembly position 37 until the conveyor system is filled with base members arranged in an edge-to-edge manner. When such a condition is reached, the conveyor belt may be deactuated or, more advantageously, it will simply be allowed to slip against the "upper" surfaces 38 of the base members, maintaining a slight pressure on the base members urging them in a feeding direction. As soon as a base member in the assembly position is removed and assembled and the assembly position is open, the edge-the-edge "stack" of base members is instantly advanced horizontally to move the next oriented base member into the assembly position.

Figures 6, 7, 8, 9, 10, 11, 12:
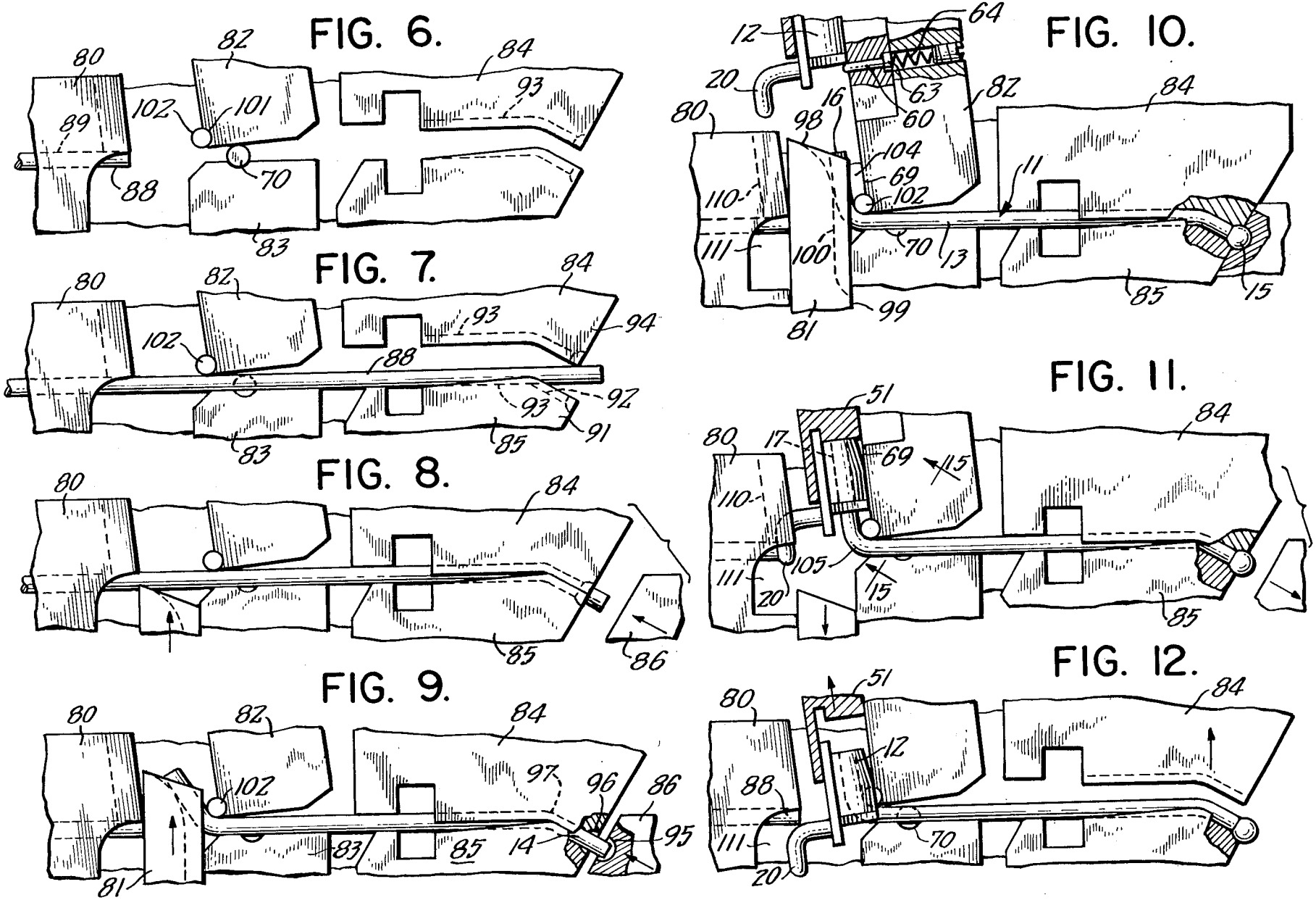
FIGS. 6–12 are sequential illustrations of a forming die arrangement according to the invention, illustrating in sequence the steps involved in forming and severing a wire hook member and assembling therewith a plastic base member.
Figure 13:
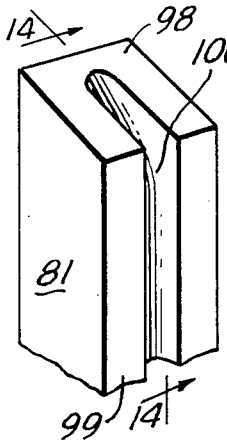
FIG. 13 is a fragmentary perspective illustration of a cut-off and bending die member used in the apparatus illustrated in FIGS. 6–12.
Figure 14:
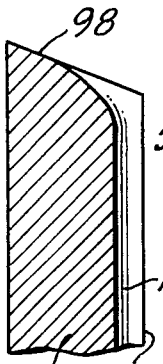
FIG. 14 is a cross sectional view as taken generally on line 14—14 of FIG. 13.

An important aspect of the invention, to be described, involves the initial forming and positioning of the wire portion 11 of the hook in a manner to accommodate automatic assembly thereof with the individual base members 12. For the purposes of the description to this point, it may be assumed that the wire forming and positioning operations have taken place, and a wire member 11 is in a position, as shown in FIGS. 10–12, with its hook mounting portion 16 projecting upward, in direct alignment with the socket 17 formed in the base member.

Figure 15:
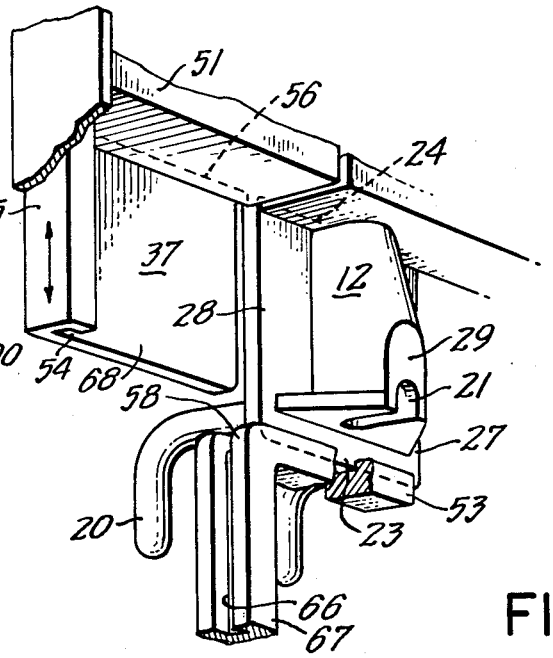
FIG. 15 is a fragmentary perspective illustration showing portions of the mechanism for feeding and aligning plastic members in preparation for assembly with a formed metal hook.

In FIG. 15, there is shown a fragmentary, prospective illustration of the assembly position 37 for the base members 12. In the illustration of FIG. 15, a base member has just been moved out of the assembly position and joined with a wire member 11 by the downward stroke of a vertically movable assembly plunger 51. The illustration of FIG. 15 shows the plunger 51 as having just returned to its normal position, ready to receive a new base member.

Figure 16:
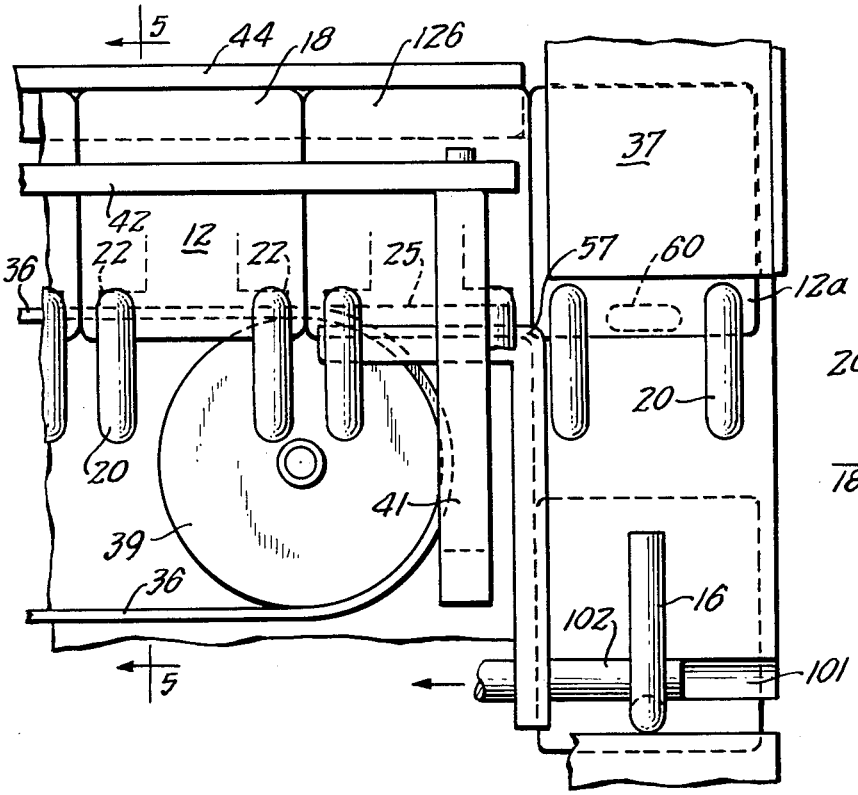
FIG. 16 is a fragmentary elevational view illustrating conveyor-like means for supplying molded base members in succession and arrangements for assembling such base sections to a formed wire hook.
Figure 17:
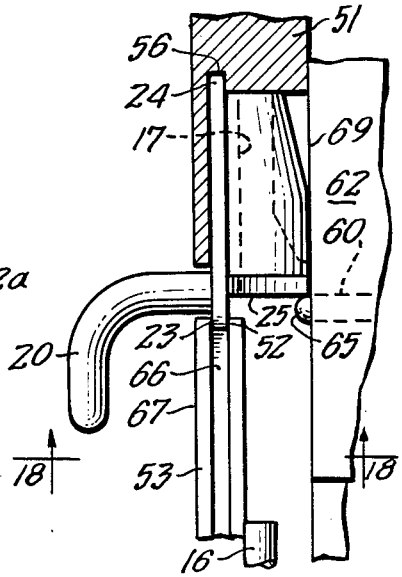
FIG. 17 is a fragmentary view, partly in section, illustrating a plastic base member in position to be assembled with a formed wire hook.
Figure 18:
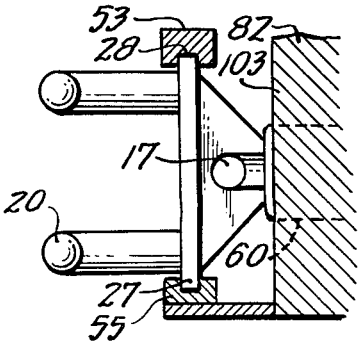
FIG. 18 is a fragmentary cross sectional view as taken generally along line 18—18 of FIG. 17.

In FIG. 16, the base member **12*a* is in the "assembly" position, while the adjacent base member, designated 12*b*, is in the "ready" position, immediately in advance of the assembly position. In FIG. 15**, the single base member illustrated is in the "ready" position.

As reflected in FIGS. 15–18, when a base member is advanced by the conveyor belt into the "ready" position, it ceases to be driven by the conveyor belt 16, but nevertheless is advanced toward the "assembly" position by pressure from the "stack" of upstream base members being advanced by the conveyor belt. When a base member reaches the ready position, its "upper" flange margin 23 enters a horizontal groove 52 formed in an L-shaped guide member 53, which both guides and supports the "upper" edge of the inverted base member. When the assembly position 37 is open, immediately following an assembly operation and retraction of the plunger 51, the base member located in the ready position is pushed into the assembly position by means of the friction forces of the belt 36 on the upstream stack of oriented base members. When in the assembly position, the base member is guided along its forward side margin 28 by means of a vertical slot 54 formed in the forward side edge member 55 of the plunger. The plunger is also provided with a downwardly facing horizontal groove 56, which receives the "bottom" flange margin 24 of the inverted base member. While moving into the assembly position, the "upper" flange margin 23 of the base member is guided by the horizontal groove 52, and when the base member is fully seated in the assembly position, a corner portion 57 (see FIG. 16) of the base member flange margin is confined by the corner portion 58 of the L-shaped guide member 53. Thus, the pressure of the upstream stack of base members serves to seat the leading base member firmly and accurately in the assembly position, wherein it is fully confined along two edges and also at one corner.

When a base member is in the "assembly" position, it is no longer supported by the belt 36, nor is it supported against downward movement by the L-shaped guide member 53. Accordingly, the retain the base member properly positioned in the assembly plunger 51, a spring urged detent element 60 is provided in an adjacent gripping die 62. As shown in FIG. 10, the detent member 60, provided with an enlarged head portion 63 is urged into a projecting position by means of a spring 64. The detent plunger 60 has a rounded or tapered end extremity 65, which normally underlies the "upper" surface 25 of the inverted base member. The base member, by itself, is nearly weightless, and so is easily held up in the position shown in FIG. 17 by means of the spring pressed detent plunger 60. However, forcible downward movement of the assembly plunger 51 easily causes the detent plunger to retract against its biasing spring 64 in order to allow downward passage of the base member for assembly.

During the downward movement of the assembly plunger 51, the base member 12, which is in the assembly position, is carried downward, while being firmly retained in the grooves 54, 56 of the plunger. Likewise, the opposite side edge flange margin 27 of the base member is guided and confined within a groove 66 formed in the downward leg 67 of the L-shaped guide member 53. As will be appreciated, during this downward movement, the base member 12 is quite precisely confined by the grooves 54, 56, 66, as well as being confined between the opposed surfaces 68 of the assembly plunger and 69 of a wire supporting die (to be described further). This enables the base member to be very precisely aligned with the upper end of the wire portion 16, so that accurate alignment of the wire portion 16 with the socket portion 17 of the base member is possible. While the wire is held firmly in position, the base member is pressed downward by the plunger 51 until the wire portion 16 is received fully within the socket 17 substantially as reflected in the inverted view of FIG. 3. Thereupon, the plunger is retracted to the position shown in FIG. 15, enabling a new base member to be transferred from the ready position into the assembly position by pressure of the upstream stack of base members on the conveyor belt. By means to be described, the members holding the wire element 11 are released and an ejection rod 70 (see FIG. 6) is actuated to eject the assembled wire and base member from the machine to ready it for a further assembly operation.

In the method of the invention, the wire member 11 of the two part hook assembly is formed in a series of cutting and forming operations, which immediately precede the automatic assembly to the wire of a molded plastic base member. Significantly, the wire member, after cutting and forming, remains tightly gripped and precisely oriented by the forming dies, which enables assembly of the base member to be carried out automatically, as part of a continuous procedure.

Figure 4:
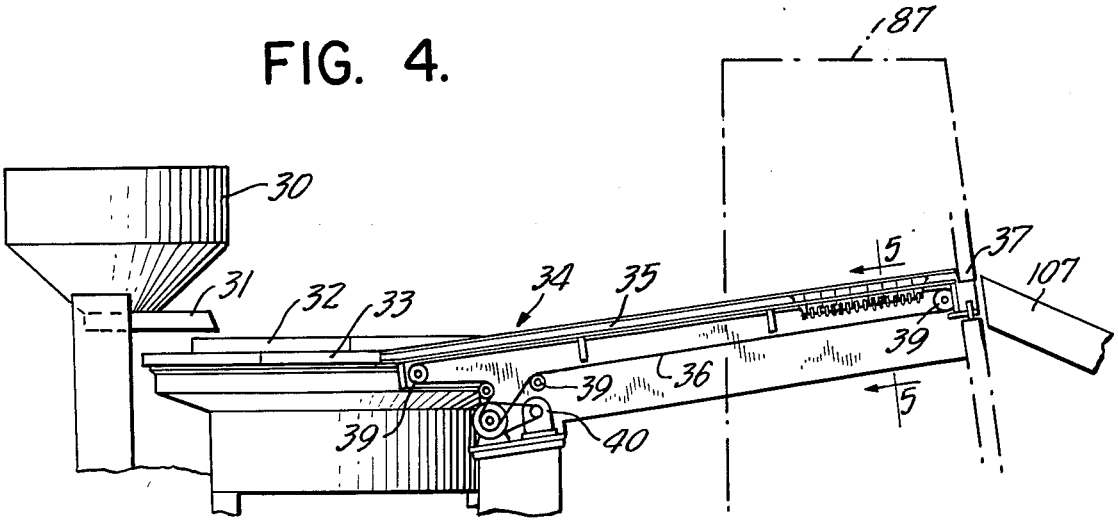
FIG. 4 is a schematic side elevational view illustrating equipment used in the manufacture of the hook of FIG. 1, for supplying oriented base members for assembly to formed metal hook members.

With specific reference to FIGS. 6–14, the primary cutting and forming dies utilized in the invention are identified by the reference numeral 80–86 (see FIG. 9) which are mounted on and form part of a forming machine 87, represented schematically in FIG. 4. The various die movements to be described advantageously are carried out in a predetermined time sequence, by means of precision adjustable cam arrangements provided in the forming machine 87. These cam arrangements, in themselves, are well known to those skilled in the art and will not be separately described herein. Conventionally, a coiled wire supply (not shown) is associated with the forming machine 87. The machine also includes means, of a well known and conventional nature, for feeding wire 88 from the supply in predetermined relatively precise incremental lengths.

In the illustrated arrangement, a wire 88 from the continuous supply is fed through a passage 89 in a first cut-off die member 80. At the beginning of a sequence of operations, a movable upper die member 84 is raised upwardly, and an end-forming die 86 is withdrawn to a retracted position (see FIG. 8). A predetermined length of the wire 88 is advanced to the right, between opposed support dies 82, 83 as shown in FIG. 7. Inner (left) end portions of the projected wire section directly overlie and are supported by a lower support die 83, while the outer (right) portions of the wire section are supported by a lower gripping die 85. In the illustrated arrangement, the support dies 82, 83 and gripping die 85 are fixed, although it will be readily understood that they may be movable if desired. To advantage, the outer gripping die 85 is provided with a guide channel 90 having a cross sectional configuration corresponding to that of the wire section 88, so that the outer end portion of the projected wire section are confined within the guide groove. The outer extremity 91 of the lower gripping and forming die 85 is directed downward, and also is provided with a guide groove section 92 adapted to closely recieve the cross sectional contours of the wire section 88.

The upper gripping and forming die 84 is provided along its outer portion with a generally semi-cylindrical confining groove 93 to receive upper portions of the wire section. The outer extremity 94 of the upper die is angled downward to conform to the outer section 91 of the lower die and is provided with a downwardly angled extension of the guide groove 93.

After projection of a wire section to the position shown in FIG. 7, the upper gripping and forming die 84 is actuated to close with the lower die 85. This performs two functions: First, it bends the outer extremity of the wire section, to form the upturned tip section 14 of the wire hook. Secondly, when the dies are closed, the wire section is tightly and inmovably gripped by the two dies and will remain so throughout the additional operations to be described.

Immediately following the gripping and forming of the wire section by the dies 84, 85, three additional operations take place. One of them is the forming of a safety ball at the outer end of the tip 14. This is accomplished by the die 86, which approaches the downwardly bent tip portion 14 of the wire section end on. Both the die 86 and the opposed end areas of the gripping and forming dies 84, 85 are provided with generally spherically shaped recess portions 95, 96. As the end-forming die 85 closes on the gripping dies 84, 85, the end extremity of the tip 14 is crushed and deforms into the spherically shaped recesses 95, 96 to form a ball end 15 (see FIG. 10). During this operation, of course, the wire is tightly gripped by the dies 84, 85, and this gripping action is assisted significantly by the change in direction of the wire at the bend 97.

More or less simultaneously with the forming of the end ball 15, the wire section is cut to length by the upward stroke of a movable cutting die 81, as shown in FIGS. 8 and 9. Continued upward movement of the movable cutting die is utilized in a novel way to form the mounting section 16 of the wire, as shown in sequence in FIGS. 8–10. To this end, the movable cutting die 81 is provided along its outer and upper faces 98, 99 with a wire-receiving groove 100. The groove 100 has a width approximating that of the wire section 11, so as to closely receive, and accurately guide and confine the wire during bending and formation of the mounting section 16.

In accordance with the invention, the fixed upper support die 82 is provided along its lower, inner corner area with a cylindrically contoured recess 101, for the slideable reception, guidance and support of a retractable bend-forming rod 102. As shown particularly in FIGS. 9 and 10, the retractable bend-forming rod 102 is positioned to constitute a fulcrum around which the mounting portion 16 of the wire hook is bent and formed during the upward stroke of the cutting and forming die 81. As shown in FIG. 10, portions of the bend-forming rod 102 (more than half of its circumference in the illustration) project inward, that is, to the left in FIG. 10, from the inner face 69 of the upper support die 82. Accordingly, after bending of the mounting portion 16, there is a predetermined clearance space 104 between the wire and the inner face 69 of the die to accommodate assembly of the plastic base member 12 (see FIG. 10).

Desirably, the bend of the support portion 16 is slightly less than 90° relative to the main portion 13 of the wire hook, to provide for a slight upward tilt of this portion in the finished product. In the forming operation, this normally requires the support portion 16 to be bent somewhat beyond the desired angle, allowing it to return to the desired angle as the cutting and bending die 81 is retracted.

As shown in FIGS. 11 and 12, after forming of the support portion 16, the cutting die 81 is retracted downward, and the assembly plunger 51 is actuated to carry a base member 12 downward and assemble it with the upturned support section 16 of the forward wire hook. Desirably, the wire receiving opening 17 in the base member is formed to have a slight interference fit with the wire, so that upon assembly the two parts will remain firmly joined unless intentionally separated. In view of the relative softness of the material of the plastic base, in relation to the sharply cut metal of the wire element, precision alignment of the base and wire members is required for the assembly operation. In accordance with the present invention, such alignment is achieved through continuous control and guidance of the edge flanges of the base member 12, and continued gripping of the wire member between the dies 84, 85 during the assembly operation. Additionally, the front and back of the base member 12 are rigidly confined between the plunger back wall 68 and the exposed surface 69 of the upper support die 82, which surface is parallel to the path of the plunger 51.

Importantly, the retractable bend forming rod 102 is withdrawn rearwardly during assembly of the base member to the wire. This clears the way for the base member to be fully received over the upwardly projecting wire portion 16, with the bend portion 105 of the wire being received within the plastic member and the wire exiting the base member through the forward slot 21.

Immediately after assembly of the base member 12 onto the formed wire, the assembly plunger 51 is withdrawn upwardly, the forming and gripping dies 84, 85 are separated by upward retraction of the upper die 84, and the completed hook assembly is discharged from the assembly position by an ejecting rod 70, which is momentarily actuated in a forward direction. The rod 70 ejects the finished wire member out of the dies and into a discharge chute 107, which discharges the finished product into a packaging receptacle or the like.

As reflected in FIGS. 10–12, for example, the stationary cut-off die 80 is provided with a pair of spaced, vertically oriented grooves 110, which accommodate the L-shaped mounting lugs 20 of the plastic base members. During downward movement of the base members, carried by the assembly plunger 51, the lugs 20 are able to pass through the grooves 110, to avoid physical interference with the cut-off die 80. Directly below the incoming wire element 88, the stationary cut-off die 80 is relieved, as at 111, to enable the base member 12 to be ejected laterally from the assembly position, as shown in FIG. 12 in particular. Ejection of the wire from the lower gripping groove 90 is enabled by providing for the walls of the groove to taper to the vanishing point in the direction of the plunger 70. This causes the wire to be lifted out of the groove 90 when the ejector rod 70 is actuated.

The techniques of the invention, both in the method for forming and assembling a two-part merchandise display hook, and in the design of the hook itself, enable truly extraordinary benefits to be realized in the manufacturing operations. Heretofore, while the two-part merchandise display hook, consisting of a molded plastic base and a formed wire hook member, has been a highly popular commercial product, it has universally involved the bulk packaging of formed wire hook members together with an equal number of separate plastic base members, in an unassembled condition. At the point of use, the merchandiser has assembled the formed wire elements with the respective plastic bases and mounted the hooks on the apertured display panels as desired. While these operations could, of course, be performed by the manufacturer, the customers, historically, have been reluctant to pay the additional manufacturing cost. With the techniques and principles of the present invention, it has become possible to preassemble the hooks at the manufacturing location at a manufacturing cost which, remarkably, is even less than the cost of packaging the separate parts, such that it is possible for both the manufacturer and the consumer to benefit, costwise as well as timewise.

Of course, automatic, multi-step forming and cutting of the wire hook members is, in general, a well known procedure. However, in accordance with the present invention, these otherwise conventional operations are carried out in a unique and advantageous manner which, for the first time, enables the entire assembly operation to be carried out in the hook-forming equipment and as an integral part of the hook-forming operations. In part, this includes special adaptations to the molded plastic base member, to provide for the precision guidance and orientation thereof for feeding and assembly operations. The invention is also directed in part to advantageous techniques for the forming of the wire member itself to enable the assembly operation to be completed while the wire remains gripped in its forming dies. To this end, the apparatus includes a laterally retractable bend-forming rod, which forms a fulcrum for the bending of the support portion of the wire. After the support portion is bent into alignment with a pre-positioned base member at the assembly position, the base member may be advanced directly into assembled relationship with the support portion of the wire. By bending the support portion around the retractable bend-forming rod 102, clearance space is provided to accommodate the guided assembly of the base member. In addition, by laterally retracting the bend-forming bar, the bend area of the hook may be received entirely within the molded base portion 12 in the desired manner.

In the manufacture and marketing of merchandise display hooks, manufacturing cost is a highly critical element of a successful product. Inasmuch as the devices are utilized in numbers of many millions, small fractions of a cent in manufacturing costs are significant factors to the success or failure of a product. In the practice of the present invention, highly significant cost savings are achieved in the production of a preassembled, two-part hook. The cost savings are of such magnitude that it has been proven possible to manufacture and package for shipment the preassembled hooks at a lesser cost than has been experienced heretofore in the manufacture and packaging of the separate components, which still have to be assembled by the customer at the installation site. This represents a quite revolutionary advance in the art of the production of two-part hooks.

It should be understood, of course, that the specific form of the invention herein illustrated and described is intended to be representative only, as certain changes may be made therein without departing from the clear teaching of the disclosure. Accordingly, reference should be made to the following appended claims in determining the full scope of the invention.

I claim:

1. The method of forming and assembling a two-part display hook, wherein the hook comprises a molded plastic base member and a formed wire hook member, the base member being provided with a socket for the reception of a section of said hook member, which comprises (a) feeding hook-forming wire lengthwise from a substantially continuous supply thereof into a wire gripping and forming station, (b) gripping said wire in the vicinity of its free end, (c) severing said gripped wire at a predetermined distance from said free end to provide a separated hook-forming wire section, (d) temporarily positioning a bend-forming die element adjacent but spaced a predetermined distance from the severed end of said separated wire section, (e) bending the severed end of said gripped wire section around said positioned die element, through a substantial angle to form a hook-mounting portion, and thereafter retracting said bend-forming die element while continuing to grip said wire section, (f) separately supplying individual molded plastic bases to an assembly position offset from and aligned with the hook-mounting portion of said wire section, (g) said base members having socket portions therein shaped and-sized to have a tight-fitting assembled relation with the hook-mounting portions of said wire sections, (h) the socket portion of a base member located in said assembly position being substantially aligned with the just formed hook-mounting portion of the gripped wire section, (i) while continuing to grip said severed wire section, guiding and advancing a base member into assembled relation with said wire section, in which said hook-mounting wire portion is received in the socket portion of said base member, and (j) thereafter releasing said gripped wire and ejecting the assembled hook.

2. The method of claim 1, further characterized by (a) prior to severing, said wire section is bent at its free end extremity at a small angle to the principal wire section providing, in the finished and assembled hook, an upwardly bent tip, (b) said bent tip and principal wire section defining a predetermined plane, (c) said hook-mounting portion of said wire section being bent in said plane.

3. The method of claim 2, further characterized by (a) said bent tip being formed prior to the severing of said wire section and the bending of said mounting portion, and (b) said wire section being gripped by said bent tip portion and adjacent portions of said principal wire section during said severing operation and during the forming of said mounting portion.

4. The method of claim 1, further characterized by (a) the operation of severing said wire and forming said hook-mounting portion being performed in a continuous sequence by means of a single, unidirectionally moving die member.

5. The method of claim 1, further characterized by (a) forming said molded plastic base members to have front and back faces, top and bottom edges, and opposite side edges, (b) said edges defining a body of generally rectangular outline and being formed to provide guide flange means along all four sides of said body, and (c) guiding and positioning said base members during feeding and assembly thereof at least in part by engagement with said guide flanges.

6. The method of forming and assembling a two part display hook, wherein the hook comprises a molded plastic base member and a formed wire hook member, the base member being provided with a socket for the reception of a section of said hook member, which comprises (a) feeding hook forming wire lengthwise from a substantially continuous supply thereof into a wire gripping and forming station, (b) gripping and bending said wire in the vicinity of its free end to form an upwardly bent wire tip for said hook, (c) thereafter severing said gripped wire at a predetermined distance from said free end to provide a separated hook forming wire section, (d) temporarily positioning a bend forming die element adjacent to but spaced a predetermined distance from the severed end of said separated wire section, (e) bending the severed end of said gripped wire section around said die element, through a substantial angle to form a downwardly bent hook mounting portion, and thereafter retracting said bend forming die element while continuing to grip said wire section in the area of its free end, (f) supplying individual molded plastic members having socket portions therein shaped and sized to have a tight fitting assembled relation with the hook mounting portions of said wire sections, (g) while continuing to grip said severed wire section, guiding and advancing a base member into assembled relation with said wire section, in which said hook mounting wire portion is received in the socket portion of said base member, and (h) thereafter releasing said gripped wire and ejecting the assembled hook.

7. The method of claim 6, further characterized by (a) said bent tip portion and said hook mounting portion being formed in a common plane, (b) feeding said base members generally at right angles to said plane to position them successively at an assembly position generally aligned with said hook mounting portion, and (c) assembling said base members to said hook forming portions by displacing said base members in the direction of said hook mounting portions while guiding said base members.

8. The method of claim 7, further characterized by (a) forming said base members to be of generally rectangular outline, provided with guide flange portions along the top, bottom and side edges, (b) guiding and confining said base members by their top and bottom flange portions while said base members are being fed to said assembly position, and (c) guiding and confining said base members by their side flange portions while said base members are being assembled with said hook mounting portions.

* * * * *